US007059247B2

(12) United States Patent
Kiyohara

(10) Patent No.: US 7,059,247 B2
(45) Date of Patent: Jun. 13, 2006

(54) INK FEEDING METHOD FOR A PRINTING MACHINE

(75) Inventor: Satoru Kiyohara, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 11/052,831

(22) Filed: Feb. 9, 2005

(65) Prior Publication Data

US 2005/0183595 A1 Aug. 25, 2005

(30) Foreign Application Priority Data

Feb. 20, 2004 (JP) ..... 2004-044032

(51) Int. Cl.
*B41F 31/02* (2006.01)

(52) U.S. Cl. ..... 101/484; 101/365

(58) Field of Classification Search ..... 101/484, 101/365, 483, 211, 350.1; 382/167; 347/15
See application file for complete search history.

(56) References Cited

U.S. PATENT DOCUMENTS

| | | | | |
|---|---|---|---|---|
| 5,029,527 A | | 7/1991 | Jeschke et al. | 101/365 |
| 5,122,977 A | | 6/1992 | Pfeiffer | 101/211 |
| 5,448,379 A | * | 9/1995 | Ishihara et al. | 358/518 |
| 5,835,626 A | * | 11/1998 | Huber et al. | 382/167 |
| 6,389,968 B1 | | 5/2002 | Sugimoto et al. | 101/365 |
| 6,412,411 B1 | | 7/2002 | Sugiyama et al. | 101/365 |
| 6,446,555 B1 | | 9/2002 | Schramm et al. | 101/365 |
| 6,450,097 B1 | | 9/2002 | Kistler et al. | 101/483 |
| 6,539,863 B1 | * | 4/2003 | Shiraishi | 101/365 |
| 6,883,432 B1 | * | 4/2005 | Yamamoto et al. | 101/484 |
| 2001/0020427 A1 | | 9/2001 | Shiraishi | 101/365 |
| 2003/0011798 A1 | | 1/2003 | Yamamoto et al. | 358/1.9 |
| 2003/0217654 A1 | | 11/2003 | Yamamoto et al. | 101/148 |
| 2003/0217658 A1 | | 11/2003 | Yamamoto et al. | 101/350.1 |
| 2003/0217659 A1 | | 11/2003 | Yamamoto et al | 101/350.1 |

FOREIGN PATENT DOCUMENTS

| | | |
|---|---|---|
| JP | 64-053845 | 3/1989 |
| JP | 11-198349 | 7/1999 |
| JP | 2003-334927 A | 11/2003 |

* cited by examiner

*Primary Examiner*—Ren Yan
*Assistant Examiner*—Wasseem H. Hamdan
(74) *Attorney, Agent, or Firm*—McDermott Will & Emery LLP

(57) ABSTRACT

An ink feeding method for a printing machine includes a first color density measuring step for measuring color density of prints at selected times, an expected color density computing step for computing, based on the color density of prints measured in the first color density measuring step, an expected color density of prints occurring after a predetermined number X of prints are made, an ink feeding rate correcting step for correcting the ink feeding rate based on the expected color density of prints computed in the expected color density computing step and a target color density of prints, a second color density measuring step for measuring color density of an Xth print in the predetermined number X of prints after the ink feeding rate is corrected, and a number of prints correcting step for varying the predetermined number X of prints based on the color density measured in the second color density measuring step and the target color density of prints.

8 Claims, 19 Drawing Sheets

Fig.15

| pattern area rate | density gradient Vn | | | | | | |
|---|---|---|---|---|---|---|---|
| | steep rise | medium rise | gentle rise | level | gentle fall | medium fall | steep fall |
| min. | m01 | m02 | m03 | 1 | m04 | m05 | m06 |
| small | m07 | m08 | m09 | 1 | m10 | m11 | m12 |
| medium | m13 | m14 | m15 | 1 | m16 | m17 | m18 |
| large | m19 | m20 | m21 | 1 | m22 | m23 | m24 |
| max. | m25 | m26 | m27 | 1 | m28 | m29 | m30 |

INK FEEDING METHOD FOR A PRINTING MACHINE

BACKGROUND OF THE INVENTION

1. Field of the Invention

This invention relates to an ink feeding method for a printing machine, for controlling an ink feeding rate by measuring color density of prints produced.

2. Description of the Related Art

A printing machine has an ink feeding apparatus for adjusting the rate of feeding ink to ink rollers. The ink feeding apparatus includes a plurality of ink keys juxtaposed in a direction perpendicular to a direction in which printing paper is transported during a printing operation. The rate of feeding ink to the ink rollers is adjusted by varying the opening degree of each ink key. In this way, the rate of feeding ink ultimately to a printing plate is adjusted.

The printing plate has areas called color patches formed in positions corresponding to the respective ink keys. The color density of the color patches actually printed on the printing paper is measured with a densitometer to adjust the opening degree of each ink key.

When printing with such a printing machine, the color density of prints may not agree with a predetermined value immediately after start of a printing operation even though the ink keys in the ink feeding apparatus have a proper opening degree. In such a case, when the color density of prints is measured and the ink feeding rate is automatically controlled, the opening degree of the ink keys, even though proper, is further adjusted in an opening direction.

Since numerous ink rollers are used in such a printing machine, a predetermined time is taken until an adjustment of the opening degree of each ink key is reflected in the rate of feeding ink to printing paper. Thus, when the ink feeding rate is automatically controlled by measuring the color density of prints immediately after adjusting the opening degree of the ink keys, the opening degree of the ink keys is further adjusted even though the opening degree is proper.

The rate of feeding dampening water to the printing plate influences the rate of feeding ink to the printing plate. Thus, when the ink feeding rate is automatically controlled by measuring the color density of prints immediately after adjusting the rate of feeding dampening water to the printing plate, the opening degree of the ink keys is further adjusted even though the opening degree is proper.

An adjustment of the opening degree of the ink keys, therefore, is prohibited immediately after start of a printing operation, or after an adjustment is made of the ink or water feeding rate, until a predetermined number of sheets are printed or until lapse of a fixed time.

However, where a long time is set for the above prohibition, the ink feeding rate cannot be controlled quickly. This presents a problem of taking a long time before the color density of actual prints settles at a target value.

On the other hand, when the opening degree of the ink keys is varied excessively to control the ink feeding rate quickly, a gross overshooting will occur before the color density of prints settles at a target value.

Applicant has proposed an ink feeding method for a printing machine, for enabling the color density of prints to settle at a target value quickly without causing a gross overshooting. This method comprises a color density measuring step for measuring color density of prints at selected times, a color density gradient computing step for computing, based on the color density of prints measured in the color density measuring step, a color density gradient representing a rate of variation in the color density of prints occurring with an increase in the number of prints, an expected color density computing step for computing, based on the color density gradient computed in the color density gradient computing step, an expected color density of prints occurring after a predetermined number of prints are made, and an ink feeding rate controlling step for controlling the ink feeding rate based on the expected color density of prints computed in the expected color density computing step and a target color density of prints (see Japanese Unexamined Patent Publication No. 2003-334927).

The ink feeding method for a printing machine described in Japanese Unexamined Patent Publication No. 2003-334927 is excellent in terms of enabling the color density of prints to settle at a target value quickly without causing a gross overshooting. However, this method has a disadvantage of requiring time and skill in adjusting parameters relating to the control of the ink feeding rate, such as the number of prints to be made to serve as a basis for computing an expected density each time, and a control coefficient for use in controlling the ink feeding rate.

SUMMARY OF THE INVENTION

The object of this invention, therefore, is to provide an ink feeding method for a printing machine, for facilitating setting of parameters relating to the control of an ink feeding rate.

The above object is fulfilled, according to this invention, by an ink feeding method for a printing machine, for controlling an ink feeding rate by measuring color density of prints, the method comprising:

a first color density measuring step for measuring color density of prints at selected times;

an expected color density computing step for computing, based on the color density of prints measured in the first color density measuring step, an expected color density of prints occurring after a predetermined number X of prints are made;

an ink feeding rate correcting step for correcting the ink feeding rate based on the expected color density of prints computed in the expected color density computing step and a target color density of prints;

a second color density measuring step for measuring color density of an Xth print in the predetermined number X of prints after the ink feeding rate is corrected; and a number of prints correcting step for varying the predetermined number X of prints based on the color density measured in the second color density measuring step and the target color density of prints.

The above ink feeding method for a printing machine controls the ink feeding rate based on the expected color density, whereby the color density of prints settles quickly at a target value. When predicting the ink feeding rate after making the predetermined number X of prints, a value of the predetermined number X of prints may be set properly as a parameter. The parameter setting operation may be carried out easily.

The predetermined number X of prints may be decreased when a difference between the color density measured in the second color density measuring step and the target color density of prints is equal to or larger than a set value.

The predetermined number X of prints may be increased or restored to an initial value when a difference between the color density measured in the second color density measuring step and the target color density of prints is smaller than a set value.

In another aspect of the invention, an ink feeding method for a printing machine, for controlling an ink feeding rate by measuring color density of prints, comprises:

a first color density measuring step for measuring color density of prints at selected times;

a color density gradient computing step for computing, based on the color density of prints measured in the first color density measuring step, a color density gradient representing a rate of variation in the color density of prints occurring with an increase in the number of prints;

an expected color density computing step for computing, based on the color density of prints measured in the first color density measuring step, an expected color density of prints occurring after a predetermined number X of prints are made;

an ink feeding rate correcting step for correcting the ink feeding rate based on the expected color density of prints computed in the expected color density computing step and a target color density of prints;

a second color density measuring step for measuring color density of an Xth print in the predetermined number X of prints after the ink feeding rate is corrected; and a number of prints correcting step for varying the predetermined number X of prints based on the color density measured in the second color density measuring step and the target color density of prints.

In a further aspect of the invention, an ink feeding method for a printing machine is provided for controlling an ink feeding rate by measuring color density of prints, the method comprising:

a first color density measuring step for measuring color density of prints at selected times;

an expected color density computing step for computing, based on the color density of prints measured in the first color density measuring step, an expected color density of prints occurring after a predetermined number X of prints are made;

an ink feeding rate correcting step for correcting the ink feeding rate based on the expected color density of prints computed in the expected color density computing step and a target color density of prints;

a second color density measuring step for measuring color density of an Xth print in the predetermined number X of prints after the ink feeding rate is corrected; and a control coefficient correcting step for correcting a control coefficient Y for use in correcting the ink feeding rate in the ink feeding rate correcting step, based on the color density measured in the second color density measuring step and the target color density of prints.

Other features and advantages of this invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

FIG. 15 is an explanatory view of a look-up table storing gradient correction factors;

DESCRIPTION OF THE PREFERRED EMBODIMENTS

Embodiments of this invention will be described hereinafter with reference to the drawings.

Figure 1:
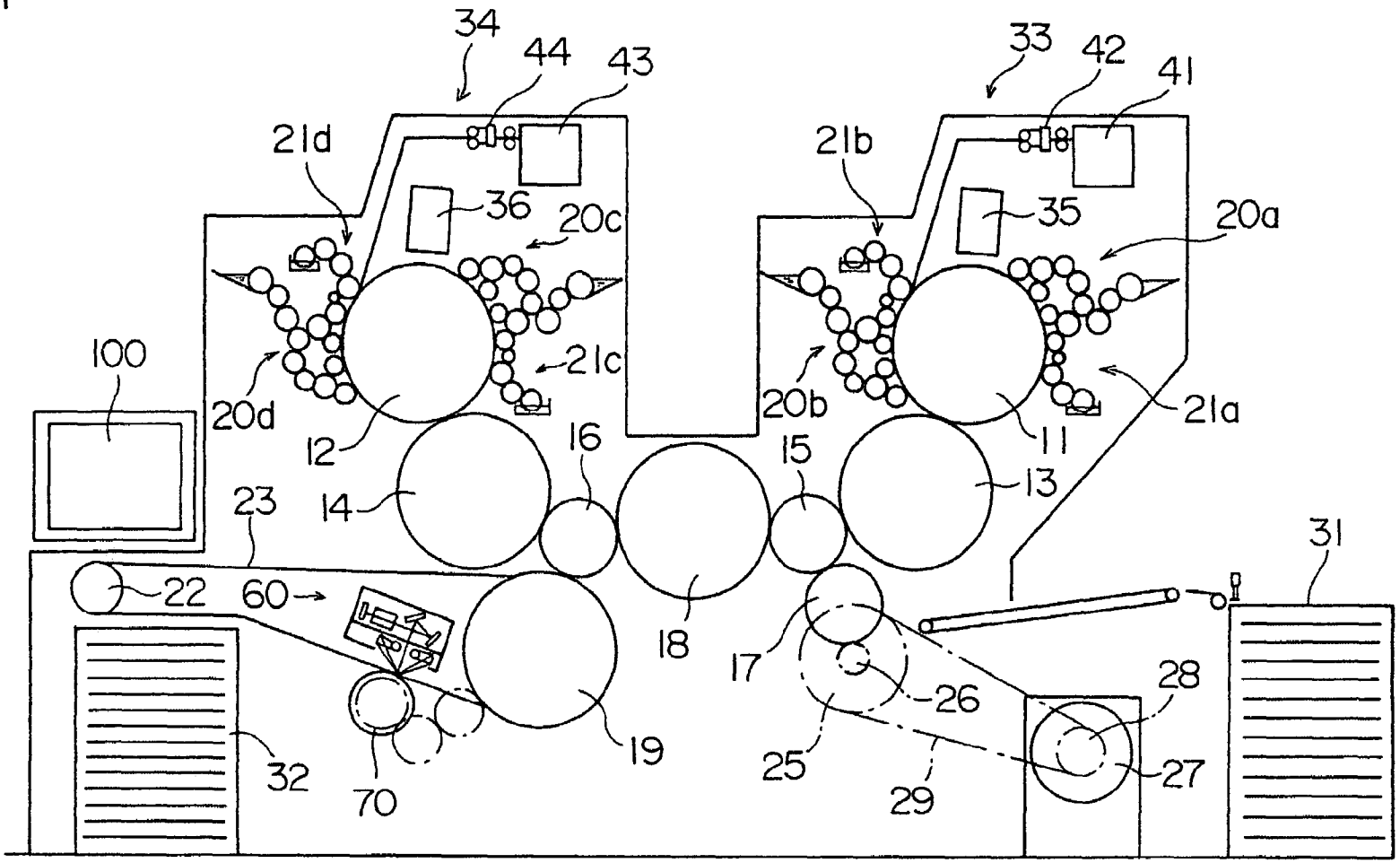
FIG. 1 is a schematic view of a printing machine to which the invention is applied.

The construction of a printing machine according to this invention will be described first. FIG. 1 is a schematic view of the printing machine according to this invention.

This printing machine records images on blank plates mounted on first and second plate cylinders 11 and 12 in a prepress process, feeds inks to the plates having the images recorded thereon, and transfers the inks from the plates through first and second blanket cylinders 13 and 14 to printing paper held on first and second impression cylinders 15 and 16, thereby printing the images in four colors on the printing paper.

The printing machine has the first plate cylinder 11, the second plate cylinder 12, the first blanket cylinder 13 contactable with the first plate cylinder 11, the second blanket cylinder 14 contactable with the second plate cylinder 12, the first impression cylinder 15 contactable with the first blanket cylinder 13, and the second impression cylinder 16 contactable with the second blanket cylinder 14. The printing machine further includes a paper feed cylinder 17 for transferring printing paper supplied from a paper storage station 31 to the first impression cylinder 15, a transfer cylinder 18 for transferring the printing paper from the first impression cylinder 15 to the second impression cylinder 16, a paper discharge cylinder 19 with chains 23 wound thereon and extending to and wound on sprockets 22 for discharging printed paper from the second impression cylinder 16 to a paper discharge station 32, an image pickup station 60 for picking up images printed on the printing paper and measuring densities of detecting patches, and a control panel 100 of the touch panel type.

Each of the first and second plate cylinders 11 and 12 is what is called a two-segmented cylinder for holding two printing plates peripherally thereof for printing in two different colors. The first and second blanket cylinders 13 and 14 have the same diameter as the first and second plate cylinders 11 and 12, and each has blanket surfaces for transferring images in two colors.

The first and second impression cylinders 15 and 16 movable into contact with the first and second blanket cylinders 13 and 14, respectively, have half the diameter of the first and second plate cylinders 11 and 12 and the first and second blanket cylinders 13 and 14. The first and second impression cylinders 15 and 16 have grippers, not shown, for holding and transporting the forward end of printing paper.

The paper feed cylinder 17 disposed adjacent the impression cylinder 15 has the same diameter as the first and second impression cylinders 15 and 16. The paper feed cylinder 17 has a gripper, not shown, for holding and transporting, with each intermittent rotation of the feed cylinder 17, the forward end of each sheet of printing paper fed from the paper storage station 31. When the printing paper is transferred from the feed cylinder 17 to the first impression cylinder 15, the gripper of the first impression cylinder 15 holds the forward end of the printing paper which has been held by the gripper of the feed cylinder 17.

The transfer cylinder 18 disposed between the first impression cylinder 15 and second impression cylinder 16 has the same diameter as the first and second plate cylinders 11 and 12 and the first and second blanket cylinders 13 and 14. The transfer cylinder 18 has a gripper, not shown, for holding and transporting the forward end of the printing paper received from the first impression cylinder 15, and transferring the forward end of the printing paper to the gripper of the second impression cylinder 16.

Figure 5:
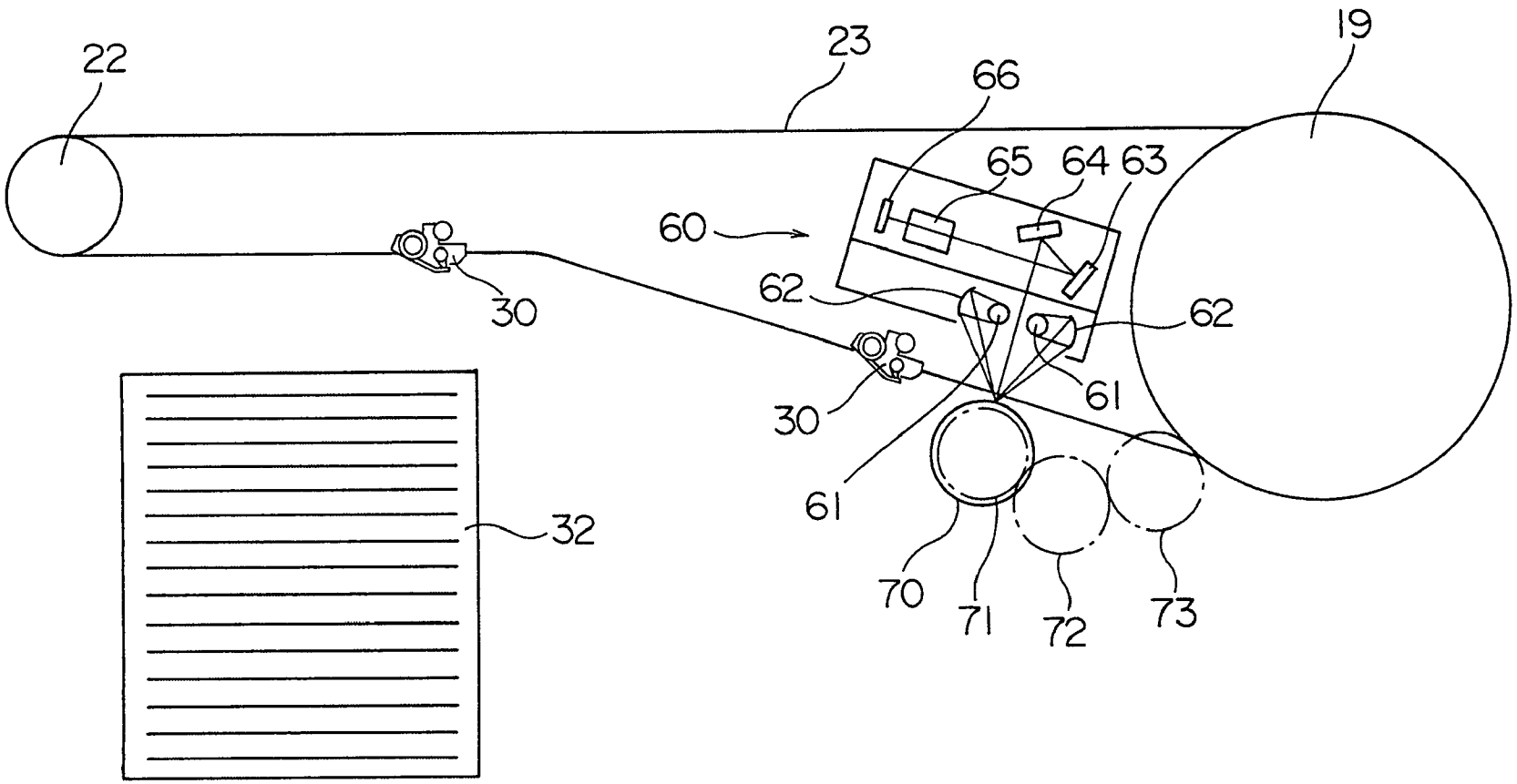
FIG. 5 is a schematic side view showing an image pickup station along with a paper discharge mechanism such as a paper discharge cylinder.

The paper discharge cylinder 19 disposed adjacent the second impression cylinder 16 has the same diameter as the first and second plate cylinders 11 and 12 and the first and second blanket cylinders 13 and 14. The discharge cylinder 19 has a pair of chains 23 wound around opposite ends thereof. The chains 23 are interconnected by coupling members, not shown, having a plurality of grippers 30 arranged thereon (FIG. 5). When the second impression cylinder 16 transfers the printing paper to the discharge cylinder 19, one of the grippers 30 on the discharge cylinder 17 holds the forward end of the printing paper having been held by the gripper of the second impression cylinder 16. With movement of the chains 23, the printing paper is transported to the paper discharge station 32 to be discharged thereon.

The paper feed cylinder 17 has a gear attached to an end thereof and connected to a gear 26 disposed coaxially with a driven pulley 25. A belt 29 is wound around and extends between the driven pulley 25 and a drive pulley 28 rotatable by a motor 27. Thus, the paper feed cylinder 17 is rotatable by drive of the motor 27. The first and second plate cylinders 11 and 12, first and second blanket cylinders 13 and 14, first and second impression cylinders 15 and 16, paper feed cylinder 17, transfer cylinder 18 and paper discharge cylinder 19 are coupled to one another by gears attached to ends thereof, respectively. Thus, by the drive of motor 27, the paper feed cylinder 17, first and second impression cylinders 15 and 16, paper discharge cylinder 19, first and second blanket cylinders 13 and 14, first and second plate cylinders 11 and 12 and transfer cylinder 18 are rotatable synchronously with one another.

The first plate cylinder 11 is surrounded by an ink feeder 20*a* for feeding an ink of black (K), for example, to a plate, an ink feeder 20*b* for feeding an ink of cyan (C), for example, to a plate, and dampening water feeders 21*a* and 21*b* for feeding dampening water to the plates. The second plate cylinder 12 is surrounded by an ink feeder 20*c* for feeding an ink of magenta (M), for example, to a plate, an ink feeder 20*d* for feeding an ink of yellow (Y), for example, to a plate, and dampening water feeders 21*c* and 21*d* for feeding dampening water to the plates.

Further, arranged around the first and second plate cylinders 11 and 12 are a plate feeder 33 for feeding plates to the peripheral surface of the first plate cylinder 11, a plate feeder 34 for feeding plates to the peripheral surface of the second plate cylinder 12, an image recorder 35 for recording images on the plates mounted peripherally of the first plate cylinder 11, and an image recorder 36 for recording images on the plates mounted peripherally of the second plate cylinder 12.

Figure 2:
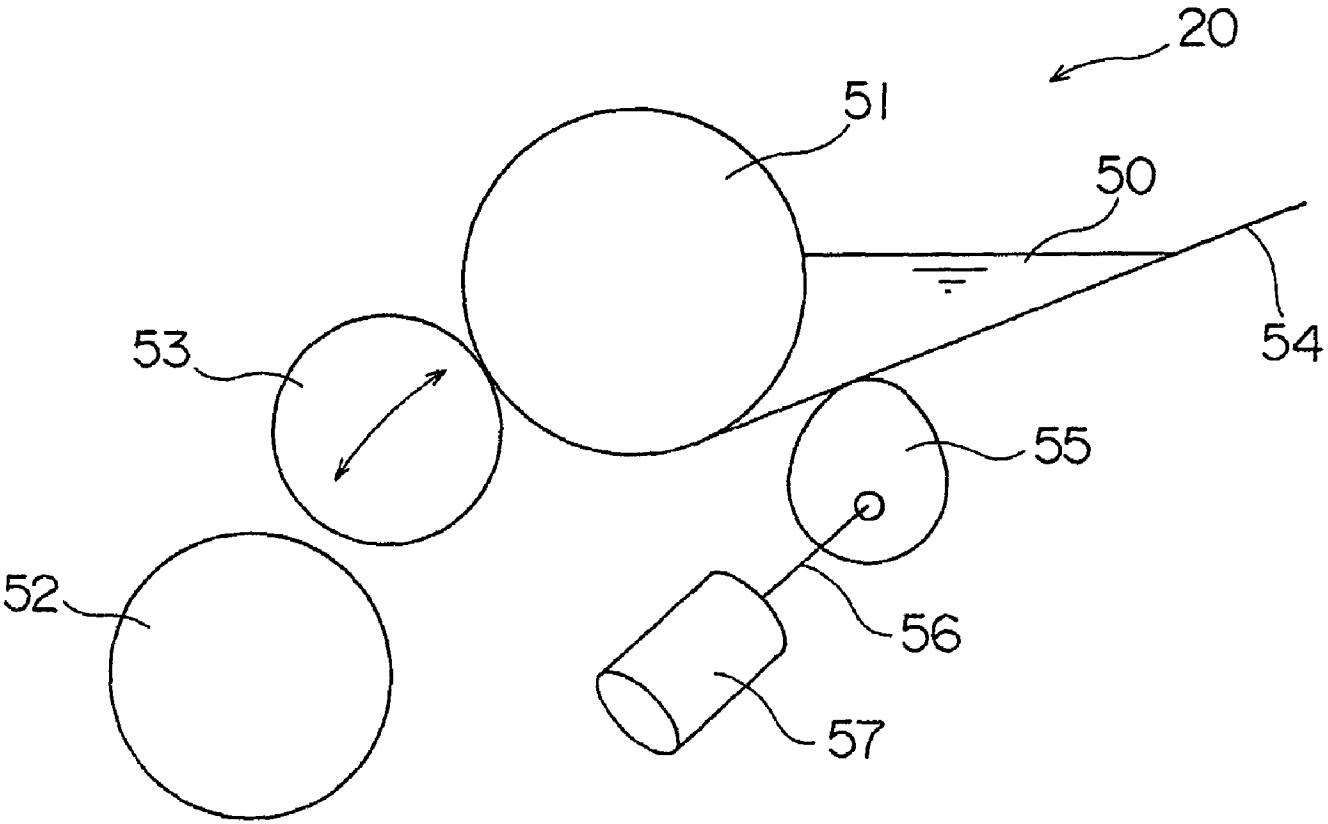
FIG. 2 is a schematic side view of an ink feeder.
Figure 3:
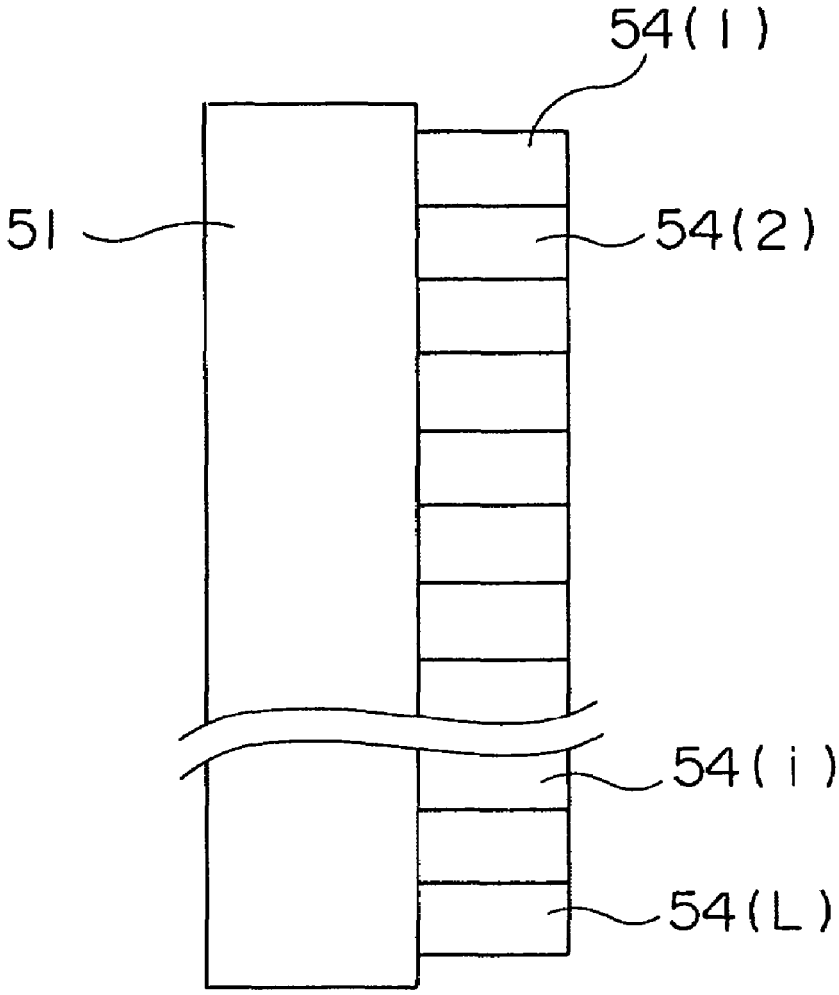
FIG. 3 is a plan view of the ink feeder.

FIG. 2 is a schematic side view of the above ink feeders 20*a*, 20*b*, 20*c* and 20*d* (which may be referred to collectively as "ink feeder 20"). FIG. 3 is a plan view thereof. Ink 50 is omitted from FIG. 3.

The ink feeder 20 includes an ink fountain roller 51 having an axis thereof extending in a direction of width of prints (i.e. perpendicular to a printing direction of the printing machine), and a plurality of ink rollers 52 (only one being shown in FIG. 2), and an ink transfer roller 53 that vibrates between the ink fountain roller 51 and a foremost one of the ink rollers 52. The ink feeder 20 further includes ink keys 54 (1), 54 (2) . . . 54 (L) (which may be referred to collectively as "ink keys 54") arranged in the direction of width of the prints. The ink fountain roller 51 and ink keys 54 define an ink well for storing ink 50.

Eccentric cams 55, L in number, are arranged under the respective ink keys 54 for pressing the ink keys 54 toward the surface of ink fountain roller 51 to vary the opening degree of each ink key 54 with respect to the ink fountain roller 51. The eccentric cams 55 are connected through shafts 56 to pulse motors 57, L in number, for rotating the eccentric cams 55, respectively.

Each pulse motor 57, in response to an ink key drive pulse applied thereto, rotates the eccentric cam 55 about the shaft 56 to vary a pressure applied to the ink key 54. The opening degree of the ink key 54 with respect to the ink fountain roller 51 is thereby varied to vary the rate of ink fed to the printing plate.

Figure 4:
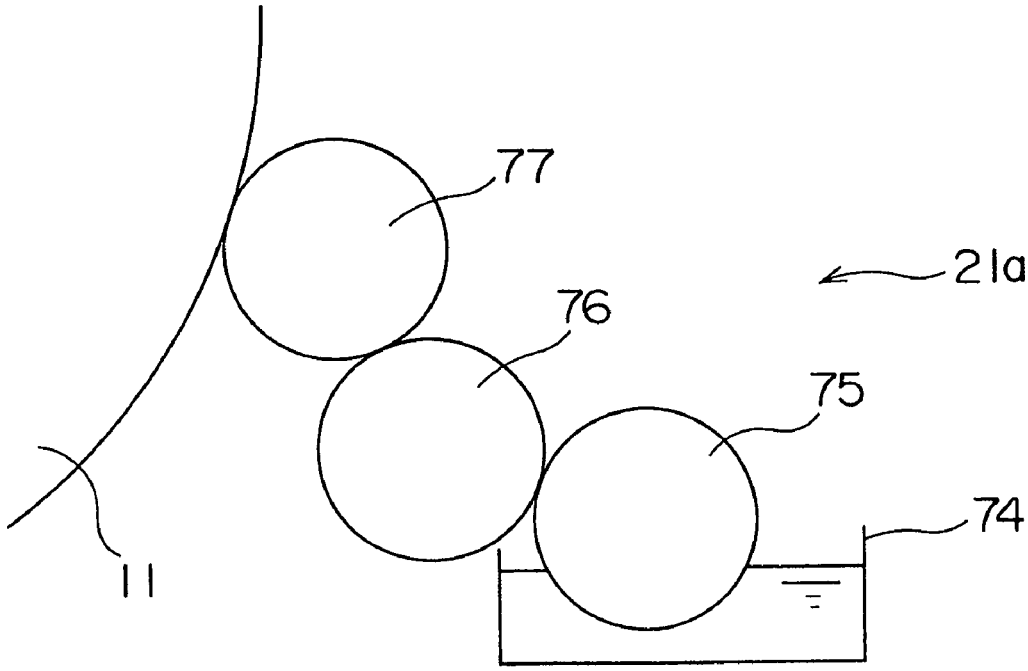
FIG. 4 is a schematic side view of a dampening water feeder.

FIG. 4 is a schematic side view of the dampening water feeder 21*a*.

The dampening water feeder 21*a* includes a water source having a water vessel 74 for storing dampening water and a water fountain roller 75, and two water rollers 76 and 77 for transferring the dampening water from the fountain roller 75 to the surface of one of the plates mounted peripherally of the first plate cylinder 11. This dampening water feeder is capable of adjusting the rate of feeding dampening water to the surface of the plate by varying the rotating rate of fountain roller 75.

The three other water feeders 21*b*, 21*c* and 21*d* have the same construction as the water feeder 21*a*.

FIG. 5 is a schematic side view showing, along with the paper discharge mechanism such as the paper discharge cylinder 19, the image pickup station 60 for picking up images printed on the printing paper and measuring densities of detecting patches printed on the printing paper.

The pair of chains 23 are endlessly wound around the opposite ends of the paper discharge cylinder 19 and the pair of sprockets 22. As noted hereinbefore, the chains 23 are interconnected by coupling members, not shown, having a plurality of grippers 30 arranged thereon each for gripping the forward end of printing paper transported. FIG. 5 shows only two grippers 30, with the other grippers 30 omitted.

The pair of chains 23 have a length corresponding to a multiple of the circumference of first and second impression cylinders 15 and 16. The grippers 30 are arranged on the chains 23 at intervals each corresponding to the circumference of first and second impression cylinders 15 and 16. Each gripper 30 is opened and closed by a cam mechanism, not shown, synchronously with the gripper on the paper discharge cylinder 19. Thus, each gripper 30 receives the printing paper from the paper discharge cylinder 19, transports the printing paper with rotation of the chains 23, and is then opened by the cam mechanism, not shown, to discharge the paper on the paper discharge station 32.

The printing paper is transported with only the forward end thereof held by one of the grippers 30, the rear end of printing paper not being fixed. Consequently, the printing paper could flap during transport, which impairs an operation, to be described hereinafter, of the image pickup station 60 to pick up images and measure densities of the detecting patches. To avoid such an inconvenience, this printing machine provides a suction roller 70 disposed upstream of the paper discharge station 32 for stabilizing the printing paper transported.

The suction roller 70 is in the form of a hollow roller having a surface defining minute suction bores, with the hollow interior thereof connected to a vacuum pump not shown. The suction roller 70 has a gear 71 attached to an end thereof. The gear 71 is connected through idler gears 72 and 73 to the gear attached to an end of the paper discharge cylinder 19. Consequently, the suction roller 43 is driven to rotate in a matching relationship with a moving speed of the grippers 30. Thus, the printing paper is sucked to the surface of the suction roller 70, thereby being held against flapping when passing over the suction roller 70. In place of the suction roller 70, a suction plate may be used to suck the printing paper two-dimensionally.

The above image pickup station 60 includes a pair of linear light sources 61 extending parallel to the suction roller 70 for illuminating the printing paper on the suction roller 70, a pair of condensing plates 62, reflecting mirrors 63 and 64, a condensing lens 65 and a CCD line sensor 66. The printing paper transported by the paper discharge mechanism including the paper discharge cylinder 19 and chains 23 is illuminated by the pair of linear light sources 61, and photographed by the CCD line sensor 66. The images on the printing paper and density data thereof are displayed on the touch panel type control panel 100.

Figure 6:
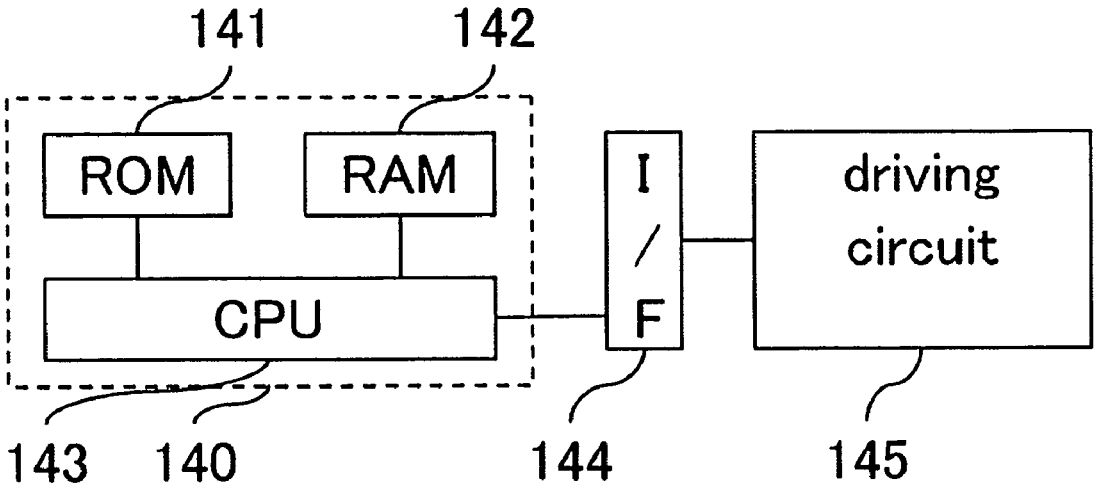
FIG. 6 is a block diagram of a principal electrical structure of the printing machine.

FIG. 6 is a block diagram showing a principal electrical structure of the printing machine. This printing machine includes a control unit 140 having a ROM 141 for storing operating programs necessary for controlling the machine, a RAM 142 for temporarily storing data and the like during a control operation, and a CPU 143 for performing logic operations. The control unit 140 has a driving circuit 145 connected thereto through an interface 144, for generating driving signals for driving the ink feeders 20, dampening water feeders 21, image recorders 35 and 36, image pickup station 60, driving devices in contact mechanisms for moving the first and second blanket cylinders 13 and 14, and so on. The printing machine is controlled by the control unit 140 to execute prepress and printing operations as described hereinafter.

In the printing machine having the above construction, a printing plate stock drawn from a supply cassette 41 of the plate feeder 33 is cut to a predetermined size by a cutter 42. The forward end of each plate in cut sheet form is guided by guide rollers and guide members, not shown, and is clamped by clamps of the first plate cylinder 11. Then, the first plate cylinder 11 is driven by a motor, not shown, to rotate at low speed, whereby the plate is wrapped around the peripheral surface of the first plate cylinder 11. The rear end of the plate is clamped by other clamps of the first plate cylinder 11. While, in this state, the first plate cylinder 11 is rotated at low speed, the image recorder 35 irradiates the surface of the plate mounted peripherally of the first plate cylinder 11 with a modulated laser beam for recording an image thereon.

Similarly, a printing plate stock drawn from a supply cassette 43 of the plate feeder 34 is cut to the predetermined size by a cutter 44. The forward end of each plate in cut sheet form is guided by guide rollers and guide members, not shown, and is clamped by clamps of the second plate cylinder 12. Then, the second plate cylinder 12 is driven by a motor, not shown, to rotate at low speed, whereby the plate is wrapped around the peripheral surface of the second plate cylinder 12. The rear end of the plate is clamped by other clamps of the second plate cylinder 12. While, in this state, the second plate cylinder 12 is rotated at low speed, the image recorder 36 irradiates the surface of the plate mounted peripherally of the second plate cylinder 12 with a modulated laser beam for recording an image thereon.

The first plate cylinder 11 has, mounted peripherally thereof, a plate for printing in black ink and a plate for printing in cyan ink. The two plates are arranged in evenly separated positions (i.e. in positions separated from each other by 180 degrees). The image recorder 35 records images on these plates. Similarly, the second plate cylinder 12 has, mounted peripherally thereof, a plate for printing in magenta ink and a plate for printing in yellow ink. The two plates also are arranged in evenly separated positions, and the image recorder 36 records images on these plates, to complete a prepress process.

The prepress process is followed by a printing process for printing the printing paper with the plates mounted on the first and second plate cylinders 11 and 12. This printing process is carried out as follows.

First, each dampening water feeder 21 and each ink feeder 20 are placed in contact with only a corresponding one of the plates mounted on the first and second plate cylinders 11 and 12. Consequently, dampening water and inks are fed to the plates from the corresponding water feeders 21 and ink feeders 20, respectively. These inks are transferred from the plates to the corresponding regions of the first and second blanket cylinders 13 and 14, respectively.

Then, the printing paper is fed to the paper feed cylinder 17. The printing paper is subsequently passed from the paper feed cylinder 17 to the first impression cylinder 15. The impression cylinder 15 having received the printing paper continues to rotate. Since the first impression cylinder 15 has half the diameter of the first plate cylinder 11 and the first blanket cylinder 13, the black ink is transferred to the printing paper wrapped around the first impression cylinder 15 in its first rotation, and the cyan ink in its second rotation.

After the first impression cylinder 15 makes two rotations, the printing paper is passed from the first impression cylinder 15 to the second impression cylinder 16 through the transfer cylinder 18. The second impression cylinder 16 having received the printing paper continues to rotate. Since the second impression cylinder 16 has half the diameter of the second plate cylinder 12 and the second blanket cylinder 14, the magenta ink is transferred to the printing paper wrapped around the second impression cylinder 16 in its first rotation, and the yellow ink in its second rotation.

The forward end of the printing paper printed in the four colors in this way is passed from the second impression cylinder 16 to the paper discharge cylinder 19. The printing paper is transported by the pair of chains 23 toward the paper discharge station 32 to be discharged thereon.

At this time, the printing paper being transported is illuminated by the pair of linear light sources 61, and is photographed by the CCD line sensor 66. Its image is displayed on the control panel 100.

After the printing process, the printing paper printed is discharged. The first and second blanket cylinders 13 and 14 are cleaned by a blanket cylinder cleaning device, not shown, to complete the printing process.

The printing machine having the above construction uses detecting patches, also known as color charts, color patches or test patches, to control the rates of feeding ink to the printing plates P.

Figure 7:
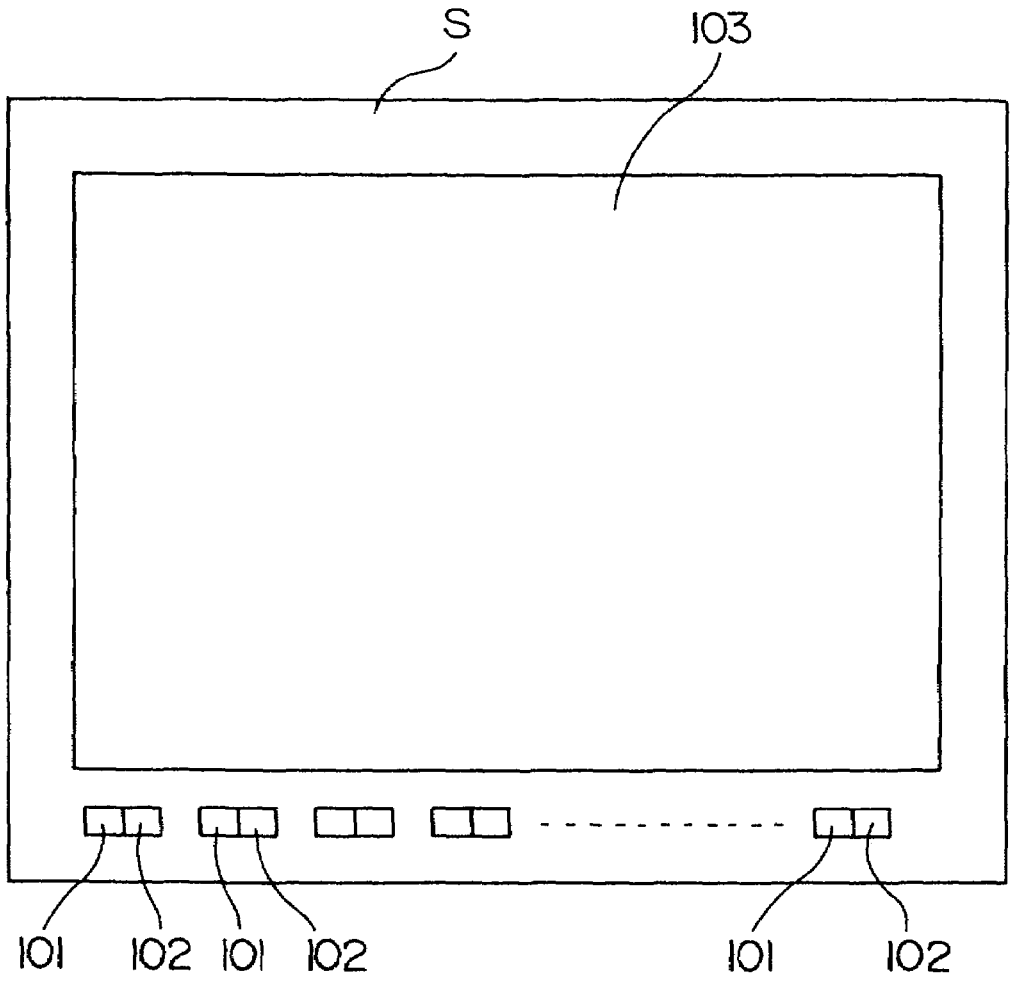
FIG. 7 is an explanatory view of first detecting patches and second detecting patches printed on printing paper as a result of a printing operation.

FIG. 7 is an explanatory view showing first detecting patches 101 and second detecting patches 102 printed on printing paper S after a printing process.

These first and second detecting patches 101 and 102 are printed in areas between one end of the printing paper S and an end of an image area 103 on the printing paper S. The first detecting patches 101 and second detecting patches 102 are arranged in discrete, adjacent pairs, L in number corresponding to the number L of areas divided in the direction of width of the printed matter (i.e. perpendicular to the printing direction of the printing machine), as are the ink keys 54 noted above. The material used for the first detecting patches 101 has a large halftone area ratio, or solid patches are used, while the material used for the second detecting patches 102 has a small halftone area ratio.

Figure 8:
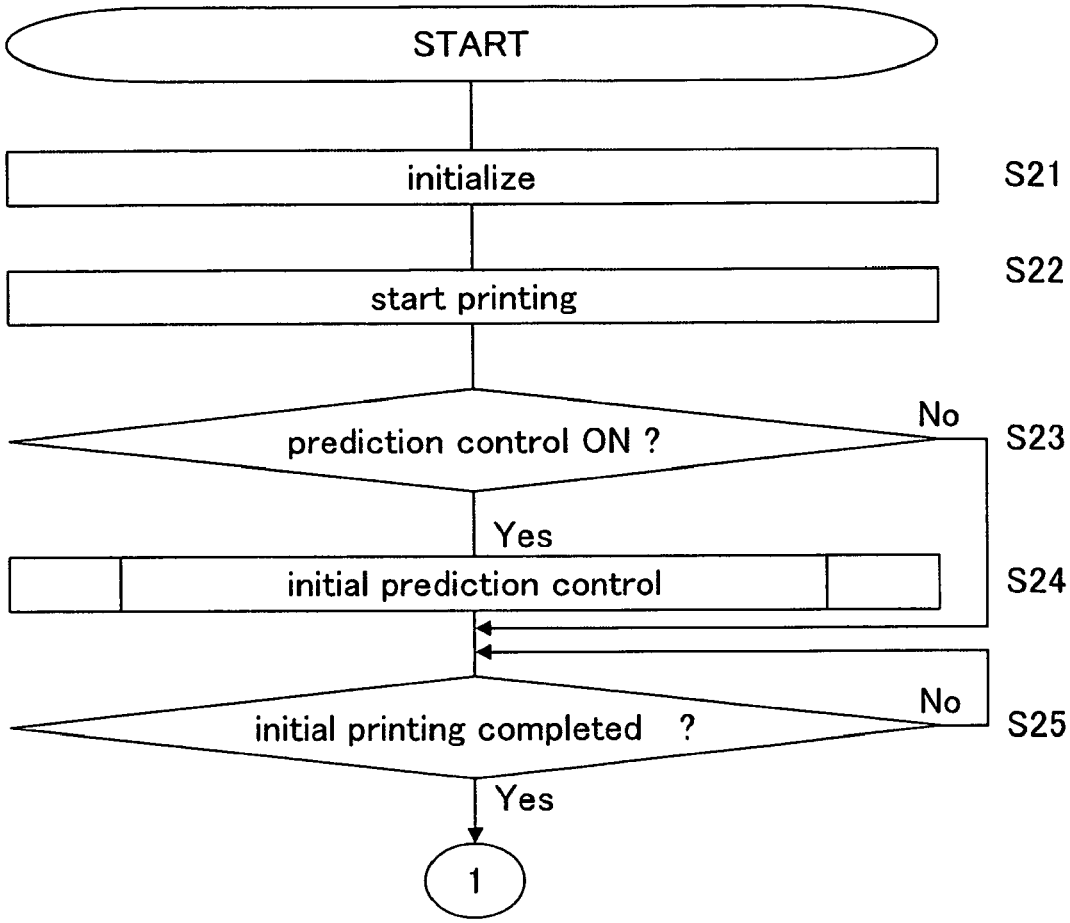
FIG. 8 is a flow chart of an overall ink feeding operation in a printing process.
Figure 9:
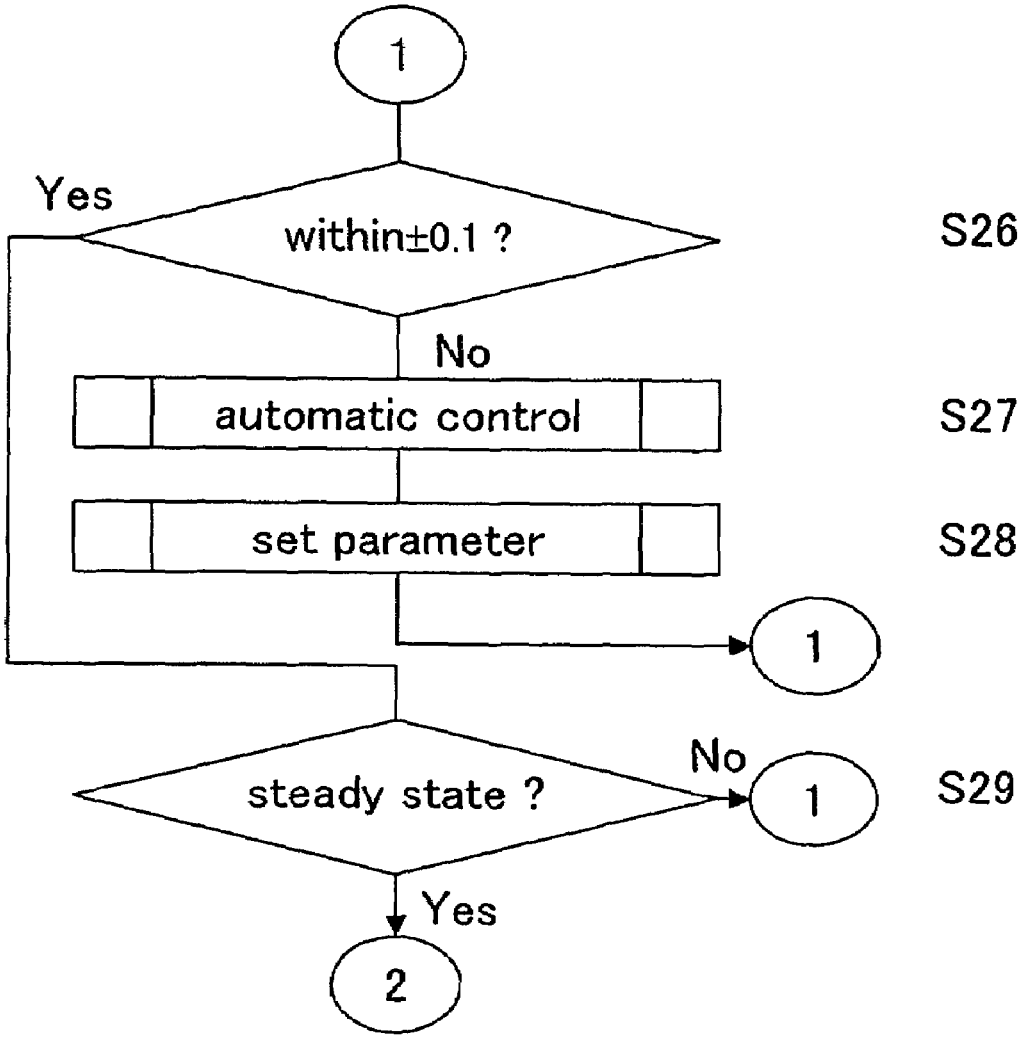
FIG. 9 is a flow chart of the overall ink feeding operation in the printing process.
Figure 10:
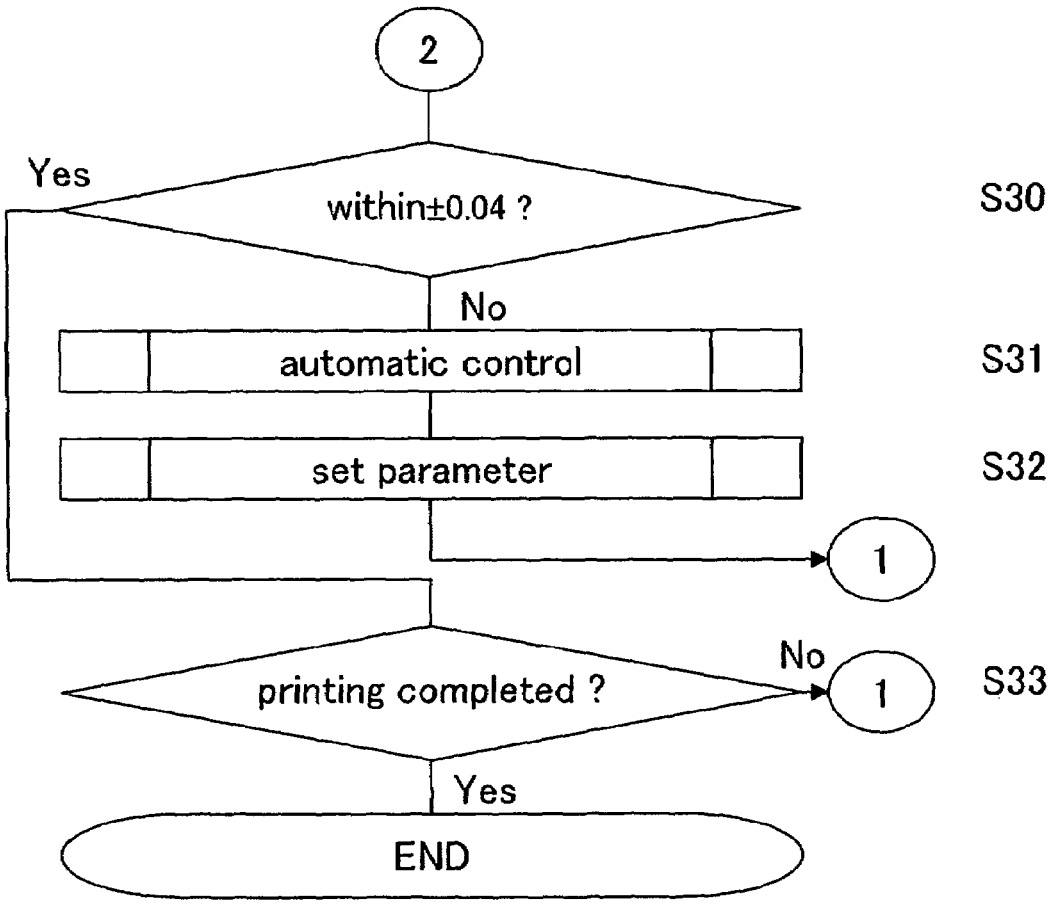
FIG. 10 is a flow chart of the overall ink feeding operation in the printing process.

An operation for controlling the ink feeding rates in the above printing process will be described next. An overall ink feeding operation in the printing process will be described first. FIGS. 8 through 10 are a flow chart showing the overall ink feeding operation in the printing process.

An initialization is carried out before a printing operation (step S21). In the initialization, the pulse motor 57 shown in FIG. 2 is driven to set the opening degree of each ink key 54 to an initial value according to the L areas. This initial value is determined based on an area ratio of an image to be printed, for example.

After the initialization, a printing operation is started (step S22). After starting the printing operation, the image pickup station 60 shown in FIG. 5 detects the color density of the first detecting patches 101 or second detecting patches 102 actually printed on printing paper S. The color density may be detected from all sheets of printing paper S, or every five printed sheets of printing paper S, for example. The color density may be measured by using either the first or second detecting patches 101 or 102. In the following description, only the first detecting patches 101 are used.

After starting the printing operation, the opening degree of each ink key 54 is not adjusted until about 100 sheets of printing paper S are printed. However, if an initial prediction control function is ON (step S23), an initial prediction control is performed as a subroutine (step S24). The initial prediction control is performed according to the flow chart shown in FIG. 11. The initial prediction control will be described in detail hereinafter.

When the initial prediction control is performed or the initial prediction control function is OFF, the machine determines whether or not an initial printing process for printing about 100 sheets of printing paper S has been completed (step S25).

After completion of the initial printing process, an automatic control is performed for automatically adjusting the opening degree of each ink key 54. This automatic control is performed, before the printing attains a steady state, only when a discrepancy between the color density of actual prints and a predetermined target color density exceeds 0.1. After the printing attains the steady state, the automatic control is performed only when the above discrepancy in color density exceeds 0.04. The color density noted above is reflectance density obtained by using a filter for each process ink.

That is, when an error in color density of the first detecting patches 101 actually printed on the printing paper S exceeds 0.1 after the initial printing process (step S26), the automatic control is performed as a subroutine (step S27). This automatic control is performed according to the flow chart shown in FIG. 13. The automatic control will be described in detail hereinafter.

The automatic control is followed by a parameter setting step (step S28) that characterizes this invention. This parameter setting step is executed according to the flow chart shown in FIG. 16 or FIG. 17. The parameter setting step will be described in detail hereinafter.

When an error in color density of the first detecting patches 101 printed on the printing paper S is 0.1 or less (step S26), the machine determines whether the printing is in the steady state or not (step S29). Whether in the steady state or not is determined by checking whether the color density of the first detecting patches 101 actually printed on the printing paper S is continuously steady throughout a predetermined number of prints, e.g. about 30 prints.

Only when the error in color density of the first detecting patches 101 actually printed on the printing paper S exceeds 0.04 after the steady state is attained (step S30), the automatic control is performed as a subroutine (step S31) and then the parameter setting step is executed as a subroutine (step S32). When the error in color density of the first detecting patches 101 actually printed on the printing paper S is 0.04 or less, the above operation is repeated until required prints are made, to complete the printing process (step S33).

Figure 11:
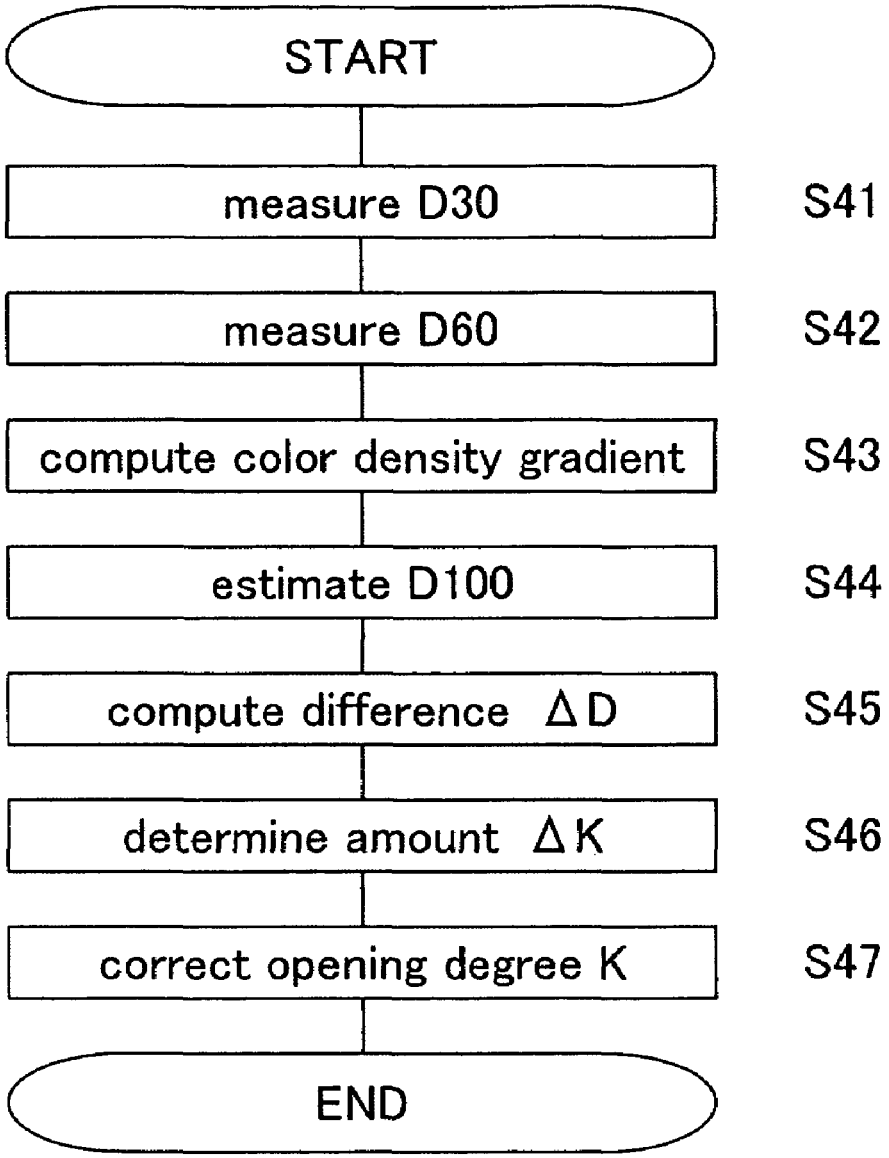
FIG. 11 is a flow chart of an initial prediction control process.
Figure 12:
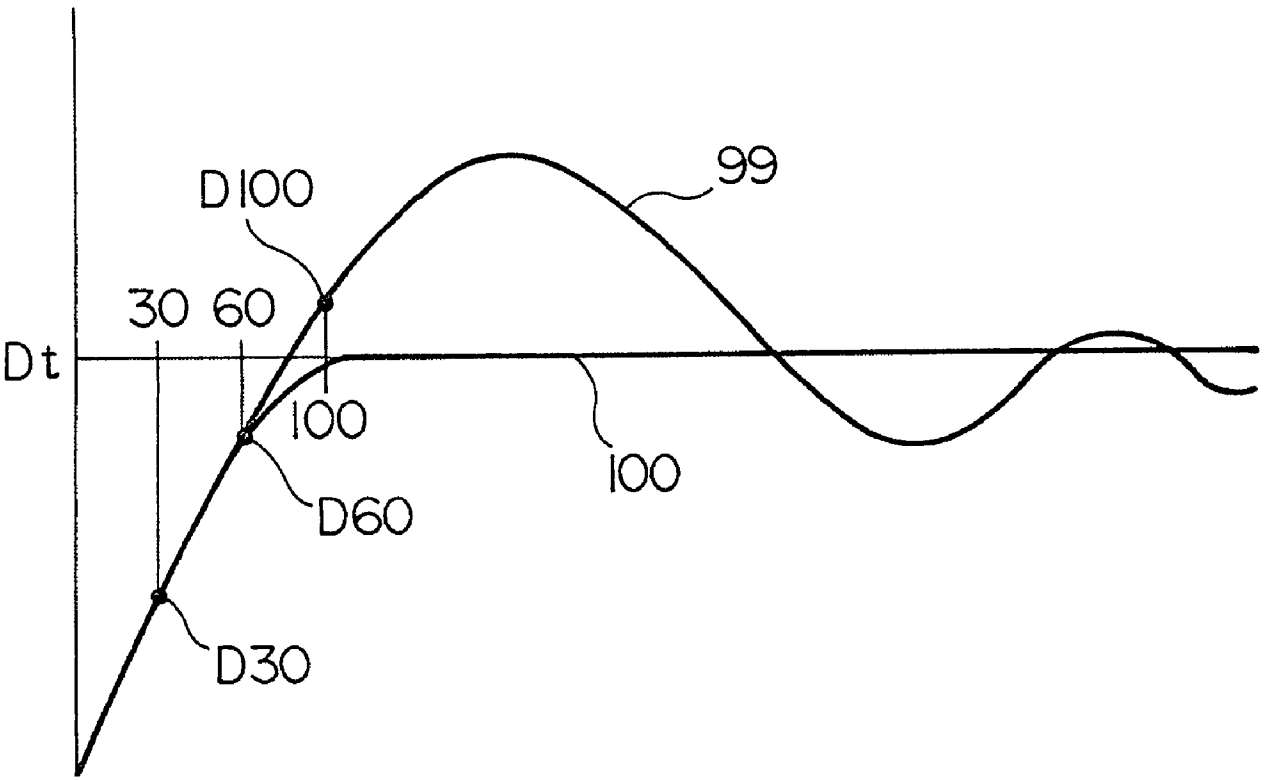
FIG. 12 is an explanatory view showing variations with time of color density of the first detecting patches actually printed on printing paper in the initial prediction process.

The initial prediction control process noted above will be described next. FIG. 11 is a flow chart which showing the initial prediction control process. FIG. 12 is an explanatory view showing variations with time in the color density of the first detecting patches 101 actually printed on the printing paper S in the initial prediction process. In FIG. 12, the vertical axis represents color density while the horizontal axis represents the number of prints.

In the initial prediction process, color density D30 of the first detecting patches 101 printed on the 30th sheet of printing paper S is measured first (step S41). Then, color density D60 of the first detecting patches 101 printed on the 60th sheet of printing paper S is measured (step S42). The color densities D30 and D60 are used to compute a color density gradient representing variations with time in the color density (step S43). Subsequently, color density D100 on the 100th sheet of printing paper S to be printed is estimated from the color density gradient (step S44).

Next, the estimated color density D100 and target color density Dt are compared, and a difference ΔD in color density is derived from the following equation (1) (step S45):

$$\Delta D = Dt - D100 \quad (1)$$

An amount of correction Δk of the opening degree of each ink key 54 is determined from the difference ΔD in color density (step S46). That is, the relationship between the amount of correction Δk of the opening degree of the keys and the difference ΔD in color density is determined from experiment beforehand. For example, the difference ΔD in color density is divided into several stages based on predetermined thresholds. The relationship between the values of the difference ΔD in color density and the amount of correction Δk of the opening degree of the keys is storied in a look-up table beforehand. The amount of correction Δk of the opening degree of the keys may be stored as a function of the difference ΔD in color density.

Subsequently, the opening degree K of each key 54 is corrected (step S47). Where the opening degree of each preceding ink key 54 is K0, the opening degree K1 of a next ink key 54 is derived from the following equation (2):

$$K1 = K0 + \Delta k \quad (2)$$

When no such initial prediction control is performed, an overshoot in color density may occur as at 99 in FIG. 12. However, when the initial prediction control is performed as described above, the color density of the first detecting patches 101 printed on the printing paper S promptly settles at the target color density Dt as at 100 in FIG. 12.

In the above embodiment, the amount of correction Δk of the opening degree of each key is derived from the difference ΔD between estimated color density D100 and target color density Dt shown in the equation (1). Alternatively, a correction factor ks of the opening degree of each key may be derived from a ratio J between estimated color density D100 and target color density Dt shown in the following equation (3), to correct the opening degree K based on this correction factor ks:

$$J = Dt/D100 \quad (3)$$

In this case also, the relationship between correction factor ks of the opening degree of each key and ratio J in color density is determined from experiment beforehand.

In this case, where the opening degree of each preceding ink key 54 is K0, the opening degree K1 of a next ink key 54 is derived from the following equation (4):

$$K1 = K0 \cdot ks \quad (4)$$

Figure 13:
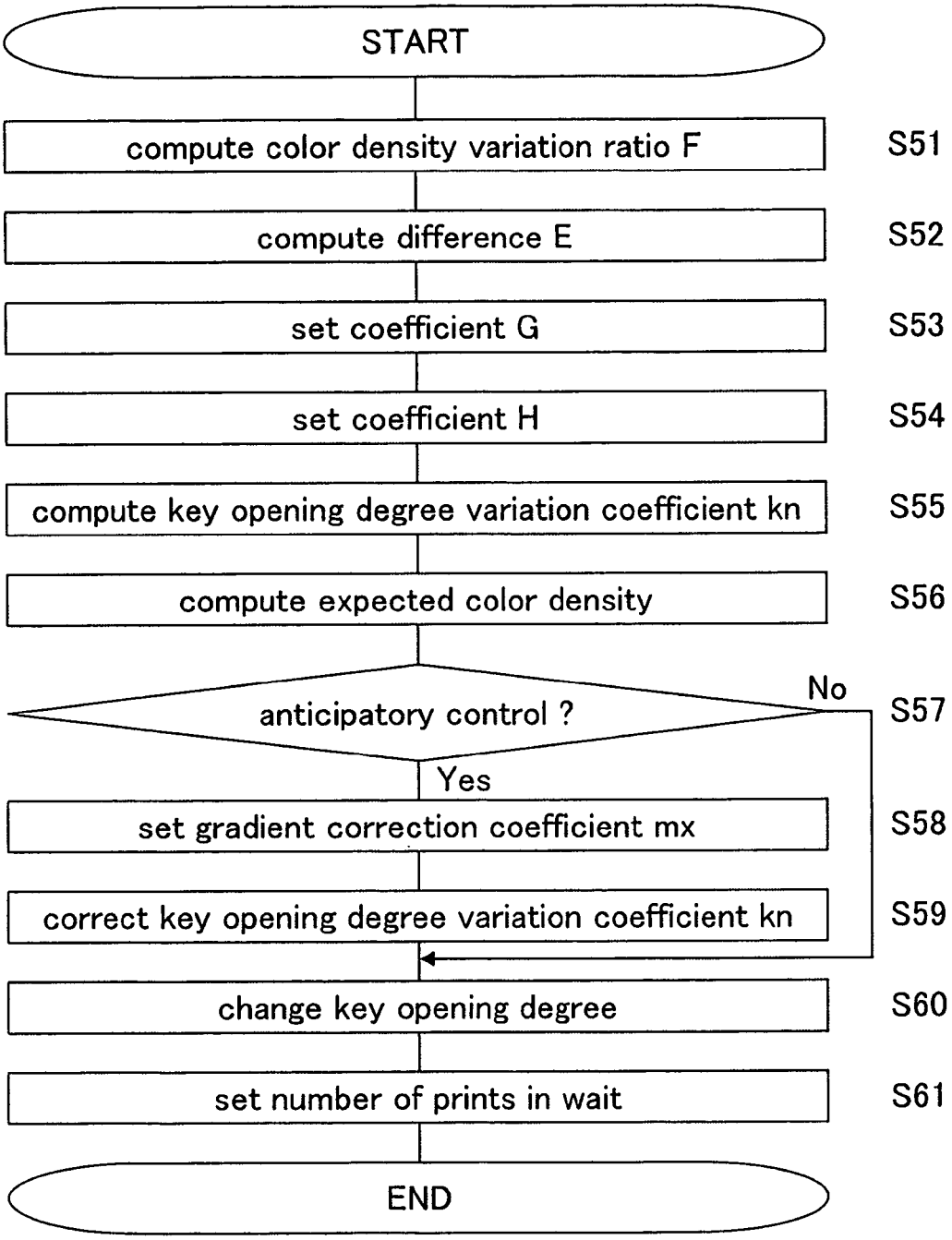
FIG. 13 is a flow chart of an automatic control process.

The automatic control process noted hereinbefore will be described next. FIG. 13 is a flow chart showing the automatic control process.

As noted hereinbefore, the automatic control process is performed only when the error in color density exceeds 0.1 before the printing attains the steady state, and only when the error in color density exceeds 0.04 after the printing attains the steady state. In the following description, the printing is assumed to have attained the steady state. The same process is performed also before the printing attains the steady state.

When the error in color density of the first detecting patches 101 actually printed on the printing paper S exceeds 0.04, a color density variation ratio F is derived from equation (5) below (step S51). When this color density variation ratio F is larger than 1, the opening degree of each ink key 54 is increased. When the color density variation ratio F is smaller than 1, the opening degree of each ink key 54 is decreased. Dn in the following equation (5) represents the color density of the first detecting patches 101 actually printed on a current sheet of printing paper S.

$$F = Dt/Dn \quad (5)$$

This color density variation ratio F is converted into an ink key opening degree variation coefficient kn by using the following equation (6):

$$kn = H \cdot G \cdot (F - 1) + 1 \quad (6)$$

where H and G are coefficients established by operations described hereinafter.

Next, a difference E between the current color density Dn and target color density Dt is derived from the following equation (7) (step S52). The value of difference E is used in determining the coefficient G.

$$E = Dt - Dn \quad (7)$$

Then, the coefficient G in equation (6) is set based on the value of difference E derived from equation (7) above (step S53).

Specifically, when difference E is 0.4 or more, a relatively large positive value is set as coefficient G. When difference E is 0.15 or more and less than 0.4, a positive value of medium quantity is set as coefficient G. When difference E is 0.04 or more and less than 0.15, a relatively small positive value is set as coefficient G. When difference E is −0.15 or more and less than −0.04, a relatively small negative value is set as coefficient G. When difference E is −0.4 or more and less than −0.15, a negative value of medium quantity is set as coefficient G. When difference E is less than −0.4, a relatively large negative value is set as coefficient G. When difference E is −0.04 or more and less than 0.04, there is no need to change the opening degree of each ink key 54, and the key opening degree variation coefficient kn is regarded as 1. This coefficient G may be varied for each color ink, or may be used commonly for all the color inks.

Next, the coefficient H in equation (6) above is established (step S54). This coefficient H is determined from pattern area rates of a subject region. Specifically, the rate of pattern area is divided into five ranges of 0 to 10%, 10 to 20%, 20 to 40%, 40 to 60%, and 60 to 100%. For the higher pattern area rate, the larger value is set as coefficient H to enable control of the greater degree. This coefficient H also may be varied for each color ink, or may be used commonly for all the color inks.

Once the coefficient G and coefficient H have been determined in the above processes, the key opening degree variation coefficient kn is derived from equation (6) above (step S55).

When computing this key opening degree variation coefficient kn, an upper limit is provided for the color density variation ratio F to avoid an excessive rate of varying the amount of ink. For this purpose, the rate of pattern area in a subject region is divided into five ranges of 0 to 10%, 10 to 20%, 20 to 40%, 40 to 60%, and 60 to 100%, and the smaller upper limit is set to the color density variation ratio F for the higher pattern area rate. This is because, in a region with a large rate of pattern area, large variations occur with the ink feeding rate even when the color density variation ratio F is small.

When the upper limit of color density variation ratio F is set to 1.2, for example, even if an actual color density variation ratio F derived from equation (5) is 1.4, for example, 1.2 is substituted for F in equation (6) to be solved. Instead of setting an upper limit to the color density variation ratio, an upper limit may be set to the key opening degree variation coefficient kn itself.

In an ordinary state, the opening degree of each ink key 54 is varied based on the key opening degree variation coefficient kn derived from the foregoing equation (6). However, an expected color density may be computed based on variations with time of measured color densities (step S56). When the result of this computation shows that an expected color density Dx after making a predetermined number X of prints will exceed the target color density Dt, the following prediction control is performed.

Figure 14:
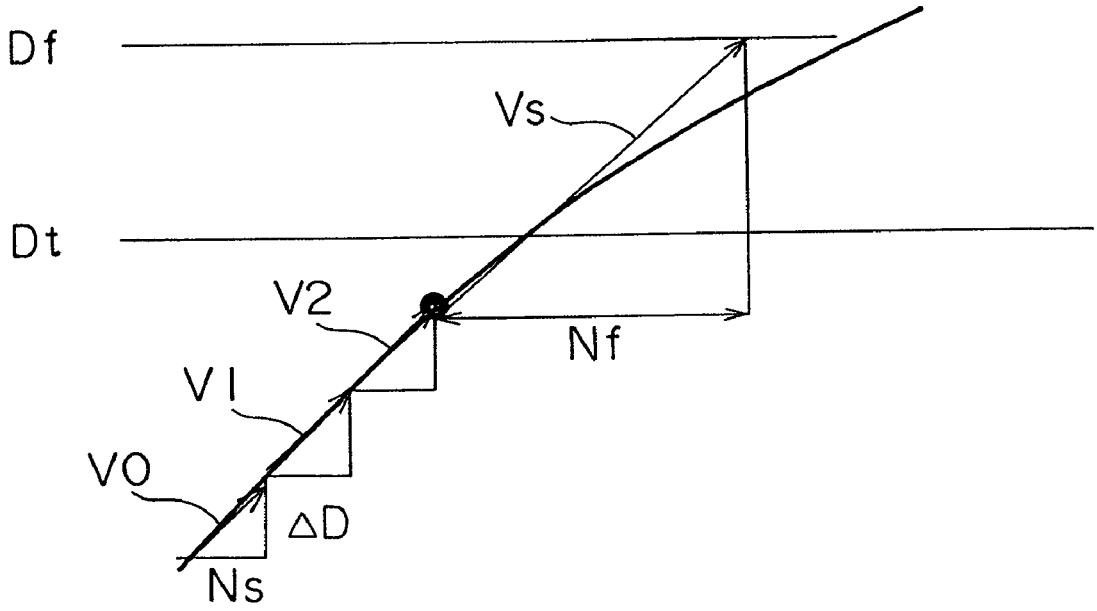
FIG. 14 is an explanatory view showing color density gradients.

Specifically, color density Dn is measured after printing every predetermined number of sheets Ns, e.g. five sheets. Density gradients V0, V1 and V2 for the past three variations are obtained from four latest measurements of color density as shown in FIG. 14. Each of these density gradients V0, V1 and V2 represents a value obtained by dividing a color density difference ΔD by the number of sheets Ns printed. Then, an average color density gradient Vs is derived from the following equation (8):

$$Vs=(V0+V1+V2)/3 \tag{8}$$

In the above equation (8), the average color density gradient Vs is obtained by simply averaging the density gradients V0, V1 and V2 for the past three variations. Instead, a computation may be carried out by weighting the density gradients V0, V1 and V2 for the past three variations. In this case, the heavier weight may be assigned to the later of the density gradients V0, V1 and V2 for the past three variations.

Subsequently, an expected color density Dx after making the predetermined number X of prints is derived from the following equation (9) (step S56):

$$Dx=Dn+Vs\cdot X \tag{9}$$

Next, whether an anticipatory control is required is determined (step S57). Specifically, when the target color density Dt exists between the current color density Dn and expected color density Dx, the anticipatory control is performed on the grounds that, if the printing were continued, the color density Dx after the predetermined number X of prints would exceed the target density Dt. When the target color density Dt does not exist between the current color density Dn and expected color density Dx, on the other hand, the opening degree of each ink key 54 is varied based on the key opening degree variation coefficient kn derived from the foregoing equation (6) without performing the anticipatory control.

When it is determined in step S57 that the anticipatory control is required, a gradient correction factor mx is set based on a current color density gradient Vn and the pattern area rate of a subject region. As shown in FIG. 15, the gradient correction factor mx is stored in a look-up table as having values varying from m01 to m30 with the pattern area rate and current density gradient Vn. Positive numbers not exceeding 1 are used as the values m01–m30 of the gradient correction factor mx. A small value is used as the gradient correction factor mx when the expected color density Dx is likely to form a major overshooting in color density.

Instead of setting the gradient correction factor mx based on the current color density gradient Vn and the pattern area rate of a subject region, the gradient correction factor mx may be set based on either one of the current color density gradient Vn and the pattern area rate of a subject region.

Subsequently, the key opening degree variation coefficient kn derived from the foregoing equation (6) is corrected by using the gradient correction factor mx (step S59). Specifically, when kn is larger than 1 (i.e. when color density is on the increase), a corrected key opening degree variation coefficient kx is derived from equation (10) set out hereunder. When kn is smaller than 1 (i.e. when color density is on the decrease), a corrected key opening degree variation coefficient kx is derived from equation (11). The corrected key opening degree variation coefficient kx corresponds to the control coefficient Y of this invention.

$$kx=(kn-1)\cdot mx+1 \tag{10}$$

$$kx=1-(1-kn)\cdot mx \tag{11}$$

In the above equations (10) and (11), the key opening degree variation coefficient is corrected by multiplying the key opening degree variation coefficient kn by the gradient correction factor mx. Instead, the key opening degree variation coefficient may be corrected by subtracting a gradient correction factor from the key opening degree variation coefficient kn.

Based on the corrected key opening degree variation coefficient kx, a new key opening degree KN is derived from the following equation (12), and the opening degree of each ink key 54 is varied by operating the pulse motor 57 shown in FIG. 2 (step S60):

$$KN=kn\cdot K \tag{12}$$

When the anticipatory control is not performed, the key opening degree variation coefficient kn is used instead of the key opening degree variation coefficient kx as described above.

Subsequently, the number of prints in wait is set in order to prohibit variations in the opening degree of each ink key until stabilization of the ink feeding state following the key opening degree variation (i.e. setting as to how many sheets should be printed before permitting variations in the opening degree of each ink key) (step S61). This completes the automatic control operation as a subroutine.

Figure 16:
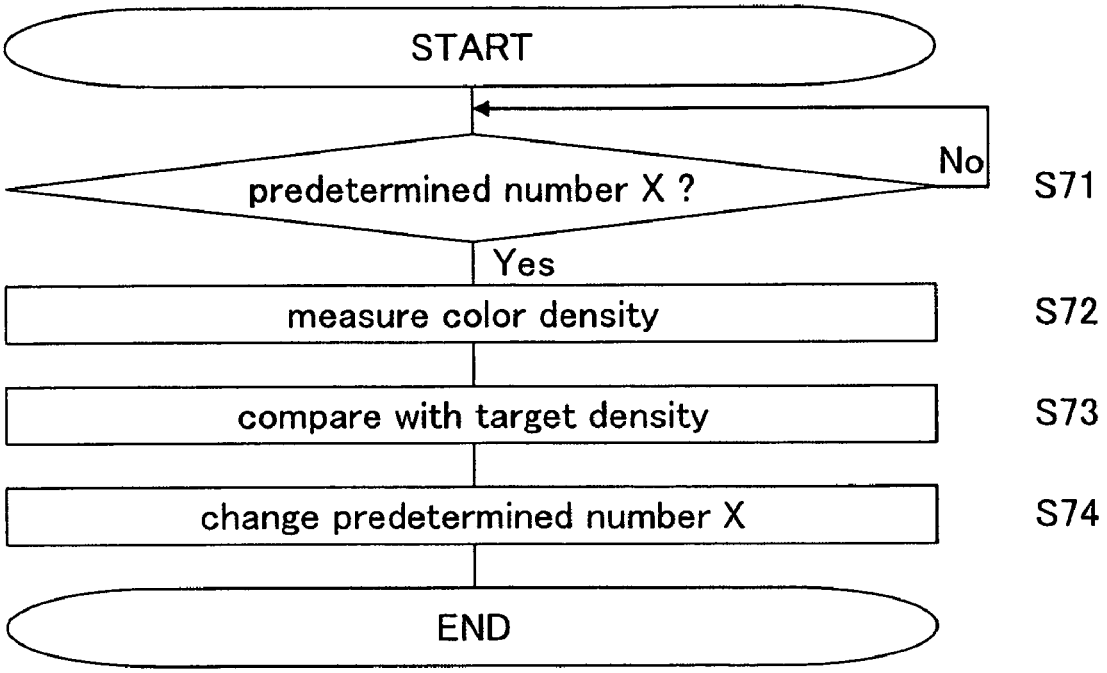
FIG. 16 is a flow chart of a parameter setting process in a first embodiment of the invention.

The parameter setting step characterizing this invention will be described next. FIG. 16 is a flow chart showing a parameter setting step in a first embodiment of this invention.

This parameter setting step is executed after the opening degree of each ink key is varied in step S60 shown in FIG. 13 and the predetermined number X of prints are made, when the automatic control is carried out in step S27 shown in FIG. 9 or step S31 shown in FIG. 10. The predetermined number X of prints is empirically obtained and set beforehand as the number of sheets suitable for checking a parameter. With an ordinary printing machine, the value of X is 20 to 30, for example.

As shown in FIG. 16, when the predetermined number X of prints have been made after varying the opening degree of each ink key (step S71), the color density Dm of the Xth print is measured (step S72). Next, the color density Dm of the Xth print is compared with the target color density Dt (step S73). Then, the value of the predetermined number X of prints is changed based on the color density Dm of the Xth print and the target color density Dt (step S74). The color density measuring step (step S72) corresponds to the second color density measuring step of this invention.

Specifically, when the difference between color density Dm and target color density Dt exceeds a predetermined value, it may be determined that color density must be checked more frequently, i.e. that the accuracy of prediction is low. The value of X is decreased in order to improve the accuracy of prediction.

That is, the computation of the expected color density is performed more frequently than has been performed each time about 20 to 30 prints, for example, are made. On the other hand, when the difference between color density Dm and target color density Dt does not exceed the predetermined value, the value of X is increased. When the value of X has already been decreased, the value of X may be restored to an initial value. When the value of X is the initial value, the initial value may be maintained even though the difference between color density Dm and target color density Dt does not exceed the predetermined value.

With the scheme described above, when predicting ink feeding rates after making the predetermined number X of prints, the value of the predetermined number X of prints may be set properly as a parameter based on the difference of color density Dm and target color density Dt. The parameter setting operation may be carried out easily.

Figure 17:
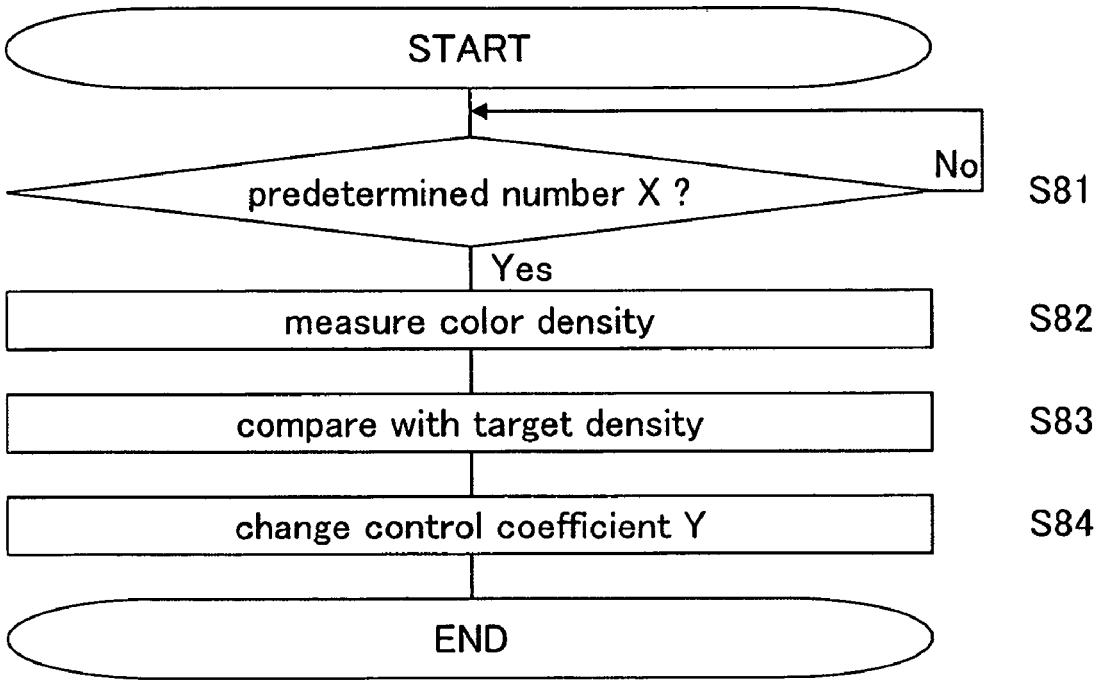
FIG. 17 is a flow chart of a parameter setting process in a second embodiment of the invention.

Next, a parameter setting step in another embodiment of the invention will be described. FIG. 17 is a flow chart showing a parameter setting step in a second embodiment of the invention.

As in the first embodiment, this parameter setting step is executed after the opening degree of each ink key is varied in step S60 shown in FIG. 13 and the predetermined number X of prints are made, when the automatic control is carried out in step S27 shown in FIG. 9 or step S31 shown in FIG. 10.

As shown in FIG. 17, when the predetermined number X of prints have been made after varying the opening degree of each ink key (step S81), the color density Dm of the Xth print is measured (step S82). Next, the color density Dm of the Xth print is compared with the target color density Dt (step S83). Then, the value of control coefficient Y is changed based on the color density Dm of the Xth print and the target color density Dt (step S84). The color density measuring step (step S82) corresponds to the second color density measuring step of this invention.

That is, the corrected key opening degree variation coefficient kx derived from equation (10) or equation (11) in step S59 of the automatic control, as described hereinbefore, is set as control coefficient Y for use in correcting the ink feeding rates. The value of control coefficient Y (i.e. the value of corrected key opening degree variation coefficient kx) is changed based on the color density Dm of the Xth print and the target color density Dt.

Specifically, the control coefficient Y is corrected in a direction for decreasing the amount of correction when the expected color density Dx of prints computed in the expected color density computing step (step S56) is smaller than the target color density Dt of prints, and the color density Dm of the prints measured in the color density measuring step (step S82) is larger than the target color density Dt. In this case, Y (i.e. corrected key opening degree variation coefficient kx) is multiplied by a value not exceeding 1, e.g. a value 0.9. The control coefficient Y is corrected in a direction for increasing the amount of correction when the expected color density Dx of prints computed in the expected color density computing step is smaller than the target color density Dt of prints, and the color density Dm of the prints measured in the color density measuring step is smaller than the target color density Dt. In this case, Y is multiplied by a value 1 or larger, e.g. a value 1.1.

Similarly, the control coefficient Y is corrected in the direction for increasing the amount of correction when the expected color density Dx of prints computed in the expected color density computing step is larger than the target color density Dt of prints, and the color density Dm of the prints measured in the color density measuring step is larger than the target color density Dt. The control coefficient Y is corrected in the direction for increasing the amount of correction when the expected color density Dx of prints computed in the expected color density computing step is larger than the target color density Dt of prints, and the color density Dm of the prints measured in the color density measuring step is smaller than the target color density Dt.

Figure 19:
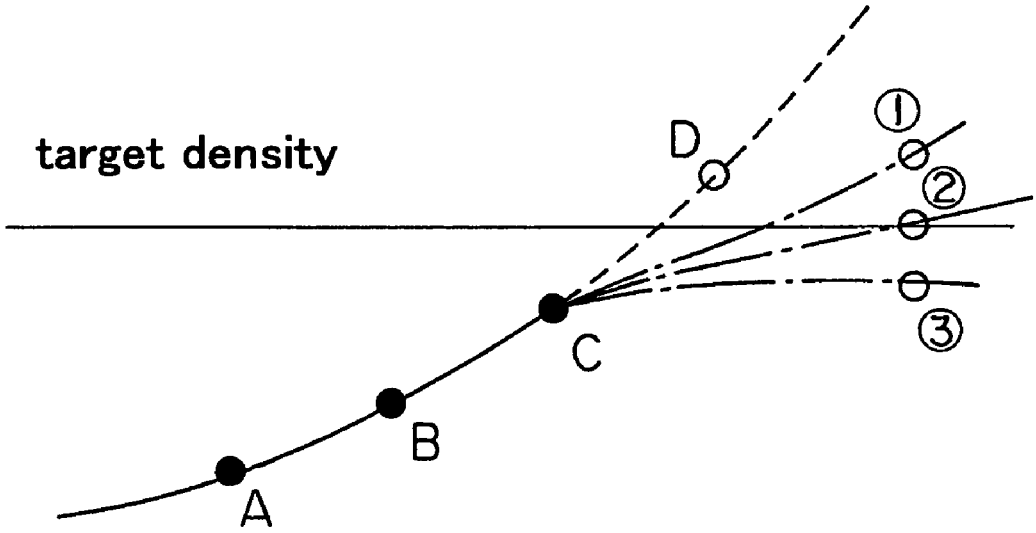
FIG. 19 is a graph schematically showing changes of color density in the second embodiment of the invention.

FIG. 19 is a graph schematically showing changes of color density in the second embodiment of the invention.

Y is corrected in the direction for decreasing the amount of correction when density changes from A to B and to C, and then to expected density D, and color density is likely to change to ① after performing the anticipatory control in step S57 described hereinbefore. Y is corrected in the direction for decreasing the amount of correction also when color density is likely to change to ③ after performing the anticipatory control in step S57. Such a scheme is capable of properly setting the value of control coefficient Y for use as a parameter in controlling the ink feeding rates. The parameter setting operation may be carried out easily.

Figure 18:
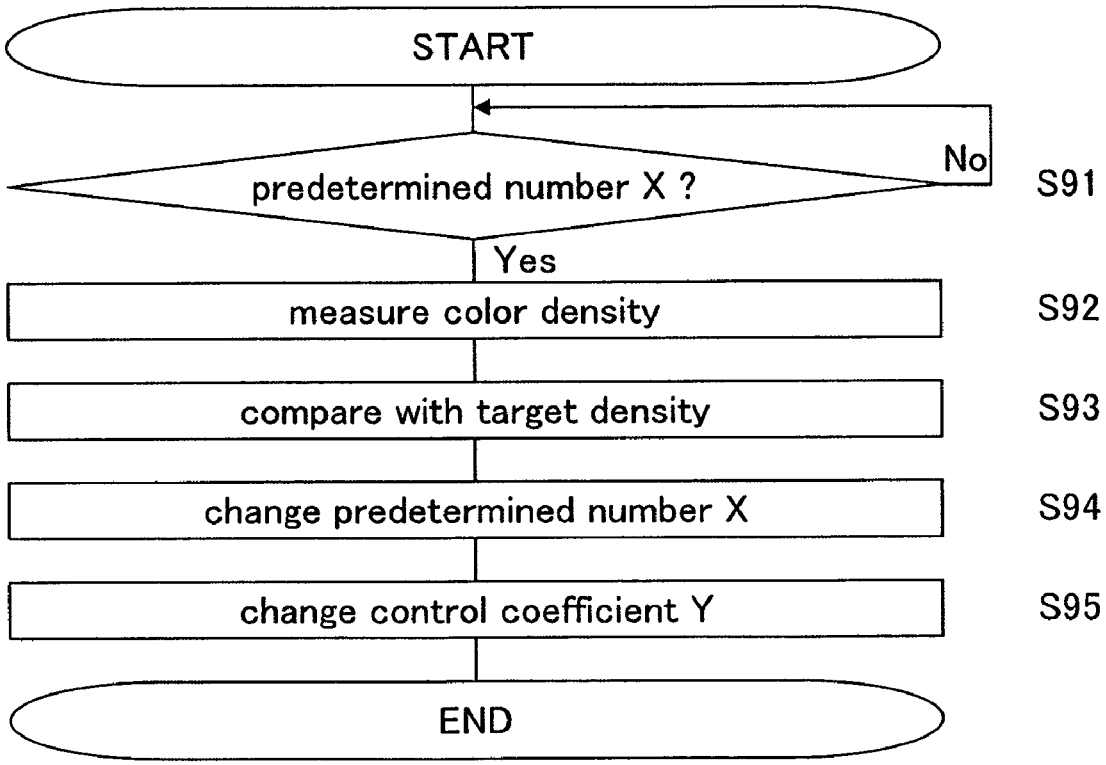
FIG. 18 is a flow chart of a parameter setting process in a third embodiment of the invention.

Next, a parameter setting step in a further embodiment of the invention will be described. FIG. 18 is a flow chart showing a parameter setting step in a third embodiment of the invention.

In this embodiment, the printing machine executes both the step of changing the predetermined number X of prints (step S74) in the first embodiment and the step of changing the control coefficient Y (step S84) in the second embodiment.

As described above, the printing machine according to this invention adjusts the opening degree of each ink key 54 by using the initial prediction control immediately after start of a printing operation, and using the anticipatory control in time of automatic control after the start of the printing operation. This is effective for quickly settling the color density of prints at a target value. A value of the number X of prints or a value of control coefficient Y may be set easily as a parameter for use in predicting ink feeding rates occurring after the predetermined number X of prints are made.

This invention determines whether the color density Dm actually measured after making the predetermined number X of prints is in agreement with the target color density Dt, as a result of correcting the opening degree of each key based on the expected color density Dx after making the predetermined number X of prints. When the color density Dm is found to deviate from the target color density Dt, the amount of correction is changed properly. Thus, the invention is not limited to the foregoing embodiments, but may employ various other computation techniques. In the described embodiments, the key opening degree variation coefficient kn (or kx) is corrected to serve as the control coefficient Y. For example, a correction may be made by varying the key opening degree based on a difference between target color density Dt and expected color density Dx. In this case, the key opening degree may be increased or decreased by a predetermined ratio or predetermined amount based on a difference between the color density Dm actually measured after making the predetermined number X of prints and the target color density Dt. Instead of correcting the key opening degree itself, a correction may be made of color density values obtained before computing the key opening degree.

In any case, it will serve the purpose of the invention as long as the key opening degree is adjusted ultimately in a direction for causing the measured color density Dm to approach or agree with the target color density Dt. The above measures are expressed collectively herein as "correcting the control coefficient Y for use in correcting the ink feeding rates".

In the foregoing embodiments, the invention is applied to the printing machine that performs a printing operation by recording images on blank printing plates mounted on the first and second plate cylinders 11 and 12, and transferring inks supplied to the printing plates through the first and second blanket cylinders 13 and 14 to printing paper held on the impression cylinders 15 and 16. However, this invention is applicable also to other, ordinary printing machines.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2004-044032 filed in the Japanese Patent Office on Feb. 20, 2004, the entire disclosure of which is incorporated herein by reference.

What is claimed is:

1. An ink feeding method for a printing machine, for controlling an ink feeding rate by measuring color density of prints, said method comprising:

a first color density measuring step for measuring color density of prints at selected times;

an expected color density computing step for computing, based on the color density of prints measured in said first color density measuring step, an expected color density of prints occurring after a predetermined number X of prints are made;

an ink feeding rate correcting step for correcting the ink feeding rate based on the expected color density of prints computed in said expected color density computing step and a target color density of prints using a control coefficient Y;

a second color density measuring step for measuring color density of an Xth print in said predetermined number X of prints after said ink feeding rate is corrected; and a control coefficient correcting step for correcting the control coefficient Y for use in correcting the ink feeding rate in said ink feeding rate correcting step, based on the color density measured in said second color density measuring step and said target color density of prints.

2. An ink feeding method as defined in claim 1, wherein said control coefficient Y is corrected in a direction for decreasing an amount of correction when the expected color density computed in said expected color density computing step is lower than said target color density of prints, and the color density measured in said second color density measuring step is higher than said target color density of prints.

3. An ink feeding method as defined in claim 1, wherein said control coefficient Y is corrected in a direction for increasing an amount of correction when the expected color density computed in said expected color density computing step is lower than said target color density of prints, and the color density measured in said second color density measuring step is lower than said target color density of prints.

4. An ink feeding method as defined in claim 1, wherein said control coefficient Y is corrected in a direction for increasing an amount of correction when the expected color density computed in said expected color density computing step is higher than said target color density of prints, and the color density measured in said second color density measuring step is higher than said target color density of prints.

5. An ink feeding method as defined in claim 1, wherein said control coefficient Y is corrected in a direction for decreasing an amount of correction when the expected color density computed in said expected color density computing step is higher than said target color density of prints, and the color density measured in said second color density measuring step is lower than said target color density of prints.

6. An ink feeding method as defined in claim 1, wherein said first color density measuring step and said second color density measuring step are executed for measuring the color density of prints by an image pickup unit arranged to pick up images of printed sheets of paper transported toward a paper discharge position.

7. An ink feeding method for a printing machine, for controlling an ink feeding rate by measuring color density of prints, said method comprising:

a first color density measuring step for measuring color density of prints at selected times;

a color density gradient computing step for computing, based on the color density of prints measured in said first color density measuring step, a color density gradient representing a rate of variation in the color density of prints occurring with an increase in the number of prints;

an expected color density computing step for computing, based on the color density gradient computed in said color density gradient computing step, an expected color density of prints occurring after a predetermined number X of prints are made;

an ink feeding rate correcting step for correcting the ink feeding rate based on the expected color density of prints computed in said expected color density computing step and a target color density of prints using a control coefficient Y;

a second color density measuring step for measuring color density of an Xth print in said predetermined number X of prints after said ink feeding rate is corrected; and a control coefficient correcting step for correcting the control coefficient Y for use in correcting the ink feeding rate in said ink feeding rate correcting step, based on the color density measured in said second color density measuring step and said target color density of prints.

8. An ink feeding method as defined in claim 7, wherein said first color density measuring step and said second color density measuring step are executed for measuring the color density of prints by an image pickup unit arranged to pick up images of printed sheets of paper transported toward a paper discharge position.

* * * * *